United States Patent [19]

Putman et al.

[11] 3,940,053

[45] Feb. 24, 1976

[54] SINGLE-PIECE CONTAINER BLANK WITH MULTI-PLY END PANELS

[75] Inventors: Jack D. Putman, Bellevue; Richard Wytko, Olympia, both of Wash.

[73] Assignee: Weyerhaeuser Company, Tacoma, Wash.

[22] Filed: Aug. 1, 1974

[21] Appl. No.: 493,803

[52] U.S. Cl. ..... 229/34 R; 229/44 R; 206/511

[51] Int. Cl.[2] ..... B65D 5/22; B65D 21/02

[58] Field of Search ..... 229/34 R, 44 R, 31 FS, 229/DIG. 11; 220/97 R; 206/511

[56] References Cited

UNITED STATES PATENTS

| | | | |
|---|---|---|---|
| 2,893,621 | 7/1959 | Harnish et al. | 229/34 R |
| 3,713,579 | 1/1973 | Chaffers | 229/44 R |
| 3,820,706 | 6/1974 | Gibson et al. | 229/34 R |

FOREIGN PATENTS OR APPLICATIONS

| | | | |
|---|---|---|---|
| 1,549,560 | 11/1968 | France | 229/34 R |

*Primary Examiner*—Davis T. Moorhead

[57] ABSTRACT

A single-piece container blank is erectable into a container having multi-ply end panels with stacking tabs extending upwardly therefrom. The multi-ply end panels offer stacking strength while the stacking tabs stabilize a resulting stack of containers. A multi-ply side panel is also a feature in one embodiment.

3 Claims, 12 Drawing Figures

Fig. 4
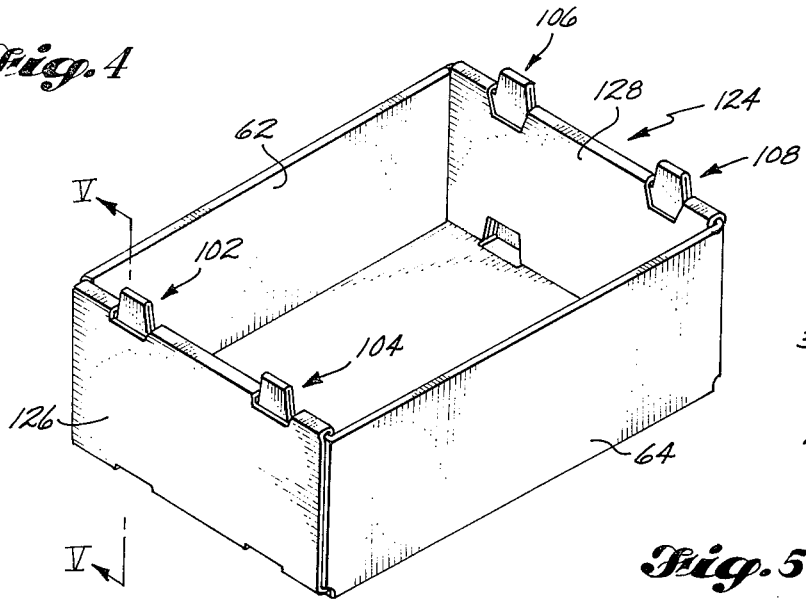
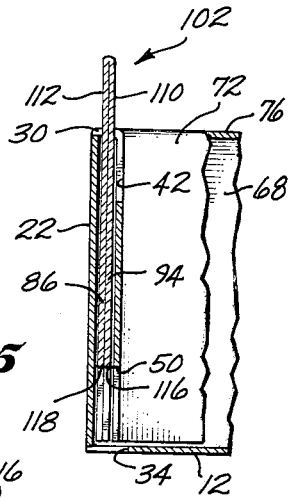
Fig. 5
Fig. 1
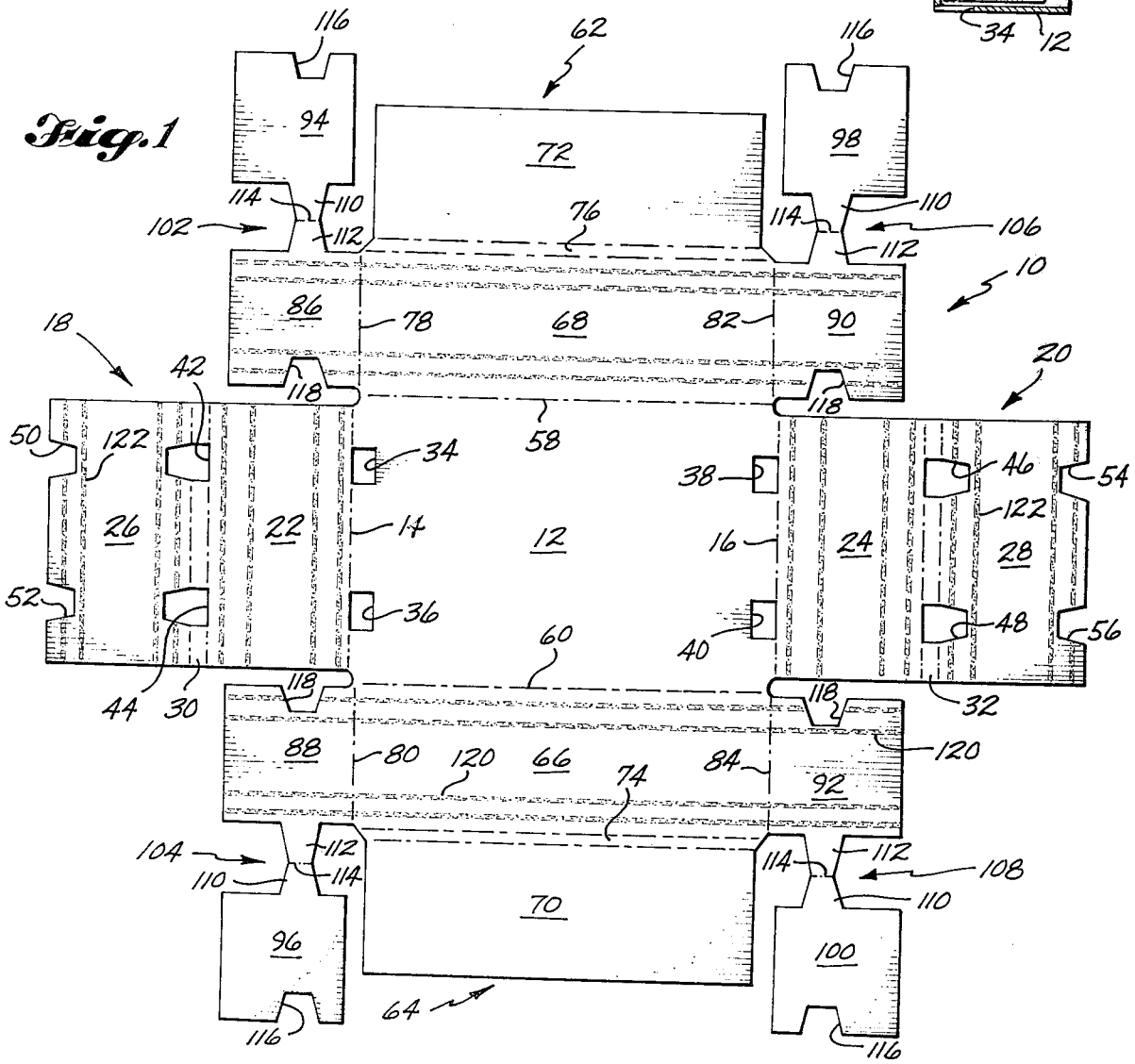

Fig. 10
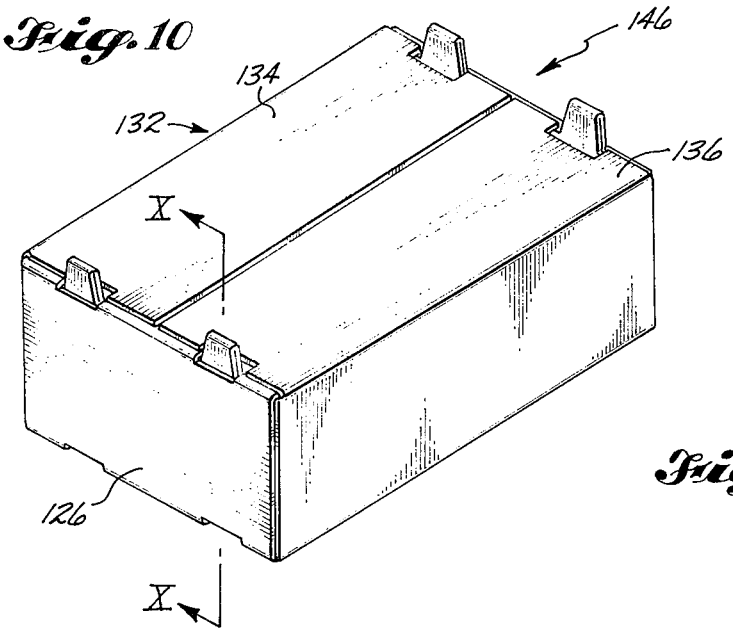
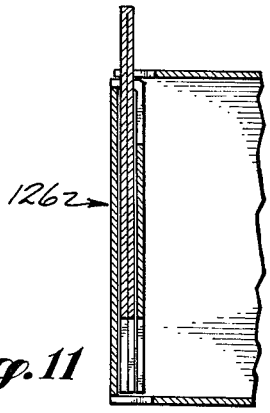
Fig. 11
Fig. 6
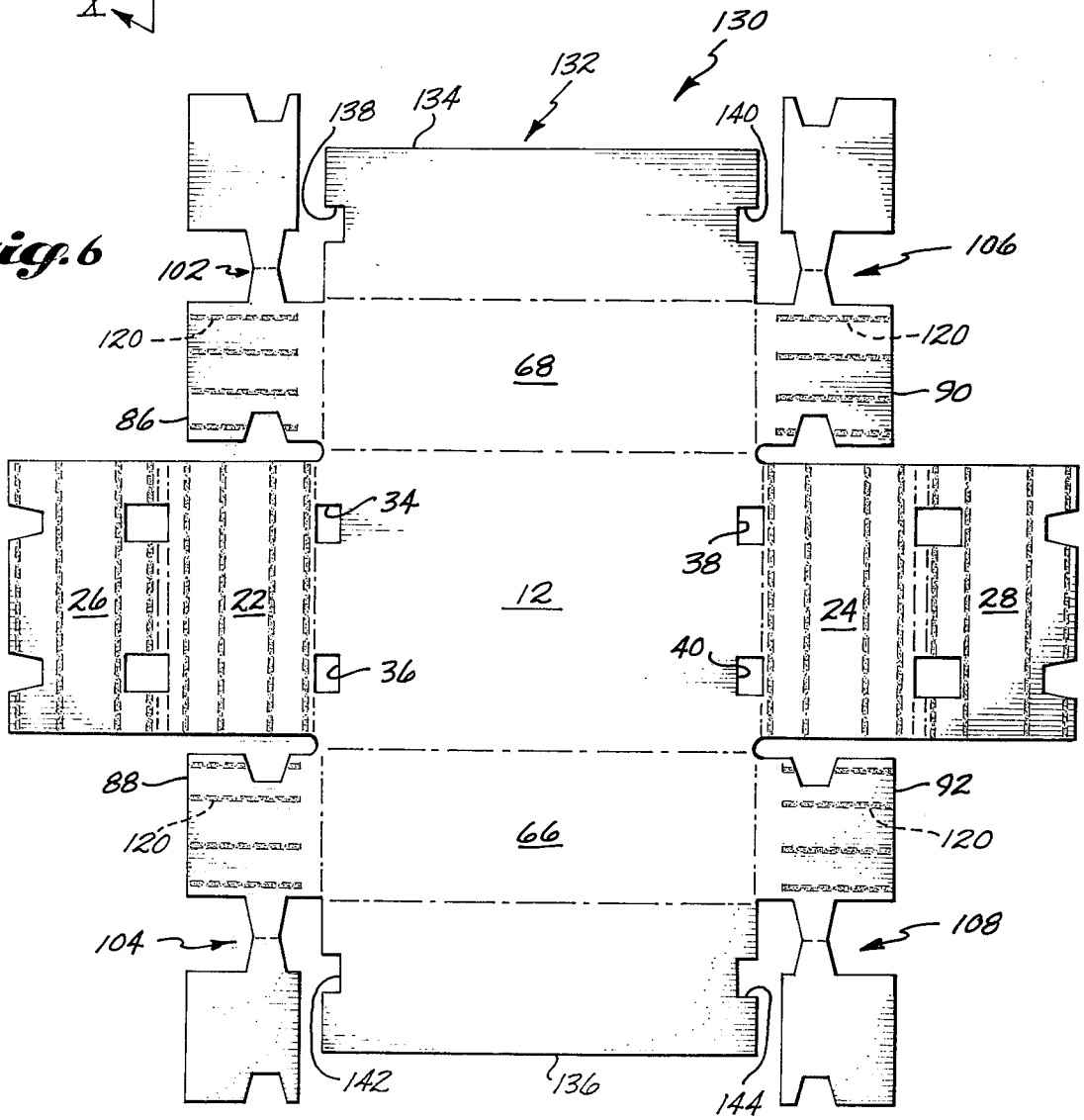

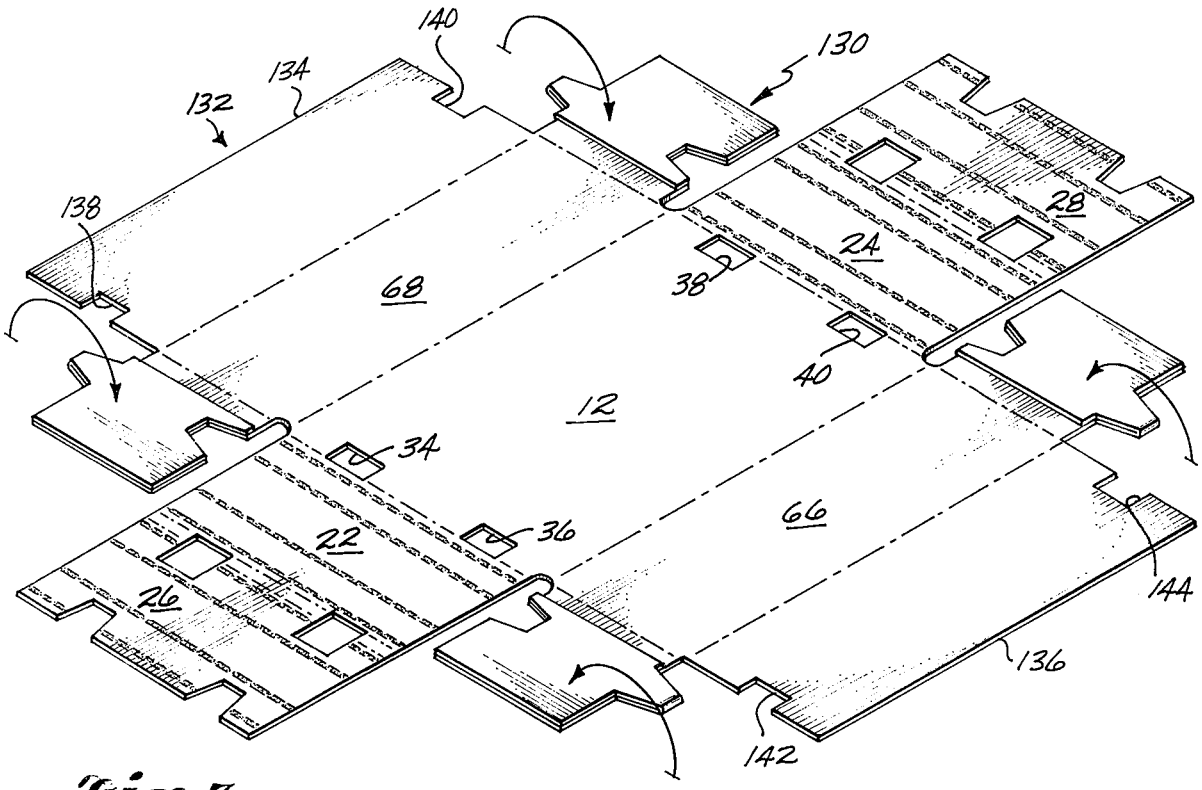
Fig. 7
Fig. 8
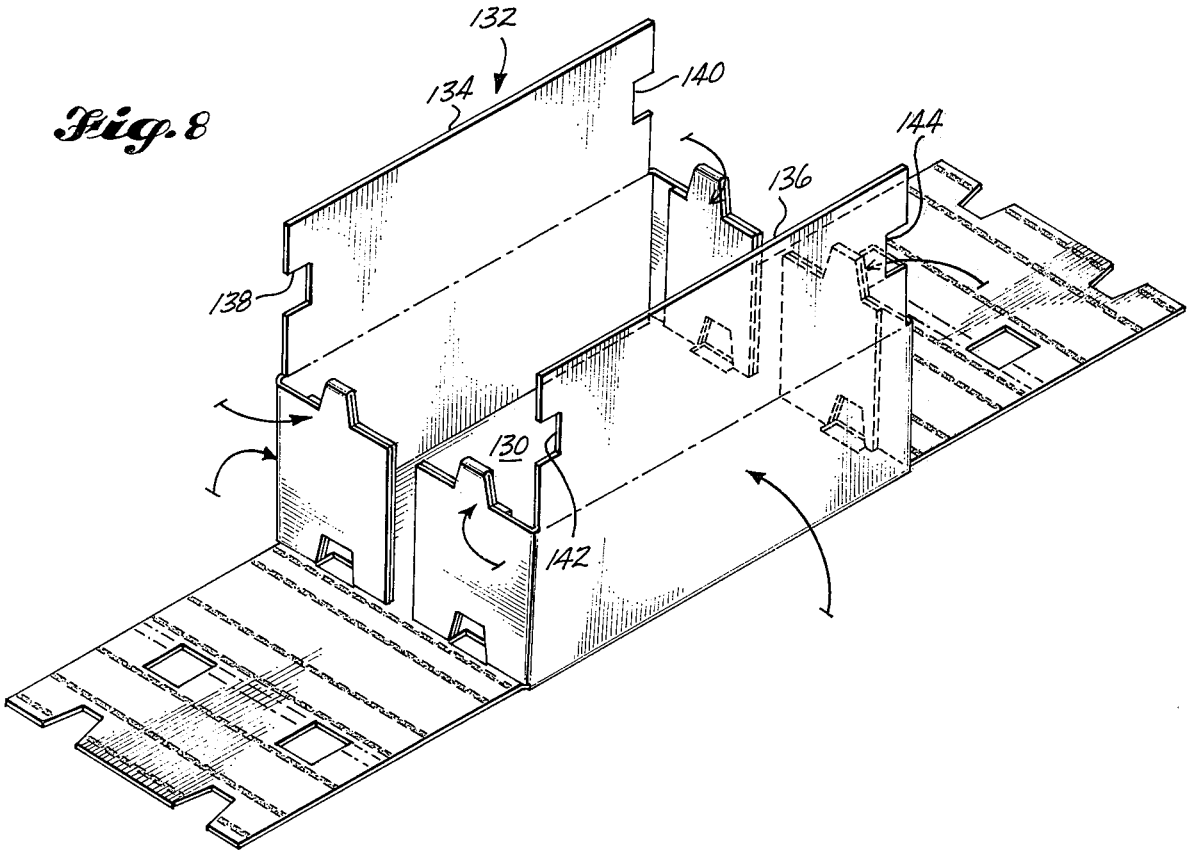

SINGLE-PIECE CONTAINER BLANK WITH MULTI-PLY END PANELS

BACKGROUND OF THE INVENTION

This invention relates generally to containers erected from foldable blanks of corrugated containerboard and, more particularly, to ones which are formed from a single-piece blank into a container that has multi-ply end panels with stacking tabs protruding upwardly therefrom.

The container of the present invention is suitable for packing such things as fruit and vegetables. Such containers must meet a variety of end use requirements, one being that the container must be strong enough to contain the product from the time it is packed until it is unpacked. For transportation requirements it is desirable that the container have sufficient vertical stacking strength so that several containers may be stacked vertically for shipment. Another desirable feature during transportation is to have stacking tabs protruding from one container into another adjacent container to prevent sway and possible destacking.

There are several containers in the prior art that do offer some of these features. For example, the patent to J. P. Hamilton - U.S. Pat. No. 3,157,346 discloses a two-piece container that would be suitable for containing product and transporting it. However, the Hamilton container has a very complicated end panel construction and, in addition, is comprised of two pieces, making it more difficult to erect than the container of the present invention. The patent to Chaffers - U.S. Pat. No. 3,713,579 also shows a multi-piece container with stacking tabs protruding from the end walls, but similarly to Hamilton, is more complicated to erect than the container of the present invention. The patent to J. M. Duncan - U.S. Pat. No. 3,114,493 does disclose a single-piece container blank which is foldable into a container having multi-ply end panels, but which does not have stacking tabs protruding upwardly from the end panels.

It will be appreciated by those skilled in the container art that it would be most desirable to have a single-piece easily-erected container having the aforementioned features for stacking, containing, and carrying products. Depending upon packing and transportation requirements, the end panel construction should be comprised of an appropriate number of plies of containerboard. In the container of the present invention, each end panel is comprised of multiple plies of containerboard and, consequently, such a container offers a great amount of vertical stacking strength. The vertical stacking tabs are designed into the blank and are integral therewith so that when the container is erected, two vertical stacking tabs will protrude upwardly from the top of each end panel. Corresponding apertures in the bottom of each container will accept the protruding stacking tabs from the container beneath when they are in a vertically stacked arrangement. Another advantage of the present invention is that, by utilizing a single-piece blank, a standard tray-forming machine can be appropriately modified in order to automatically erect the container if desired.

Accordingly, from the foregoing, one object of the present invention is to provide a single-piece container blank which can be erected to a suitable container having multi-ply end panels with integral stacking tabs protruding upwardly from their top edges.

Another object of the present invention is to provide a suitably designed container blank having sufficient stacking strength in the erected condition such that a plurality of such containers may be stacked one atop the other with stacking tabs interlocking in order to form a relatively stable stack.

Still a further object of the present invention is to provide a single-piece container blank that may be automatically erected by suitable forming machinery.

These and other objects of the invention will become apparent upon reading the following specification in conjunction with the attached drawing.

SUMMARY OF THE INVENTION

Briefly, this invention is practiced in one form by cutting from a generally rectangular piece of containerboard a single-piece blank having a bottom panel with a pair of side walls extending outwardly from either side of the bottom panel through hinge lines and a pair of outer end walls similarly connected to the bottom panel on the opposite ends thereof. Hingedly connected to each end of the side walls is an interior double-ply end panel.

The interior double-ply end panels are comprised of first and second split interior end walls interconnected by an integral stacking tab. Attached to each outer end wall through a double hinge line is an inner end wall which is adapted to be folded over the interior double-ply end panels when they are in the erected state.

In one configuration of the present invention, another side wall is hingedly connected to the first side wall in order to form a double-ply side panel construction, while in an alternative embodiment the hingedly attached wall forms the top closure means of the erected container. Appropriately positioned apertures are provided in the bottom panel to accept the stacking tabs protruding from the adjacent container when in the stacked mode.

BRIEF DESCRIPTION OF THE DRAWING

FIG. 1 is a plan view showing the single-piece container blank.

FIG. 4 is an isometric view showing the container in the erected state.

FIG. 5 is a section view taken along line V—V of FIG. 4 and shows the multi-ply end panel construction.

FIG. 6 is a view similar to FIG. 1, but shows a slightly different embodiment of the present invention.

FIG. 7 is an isometric view depicting a folding step.

FIG. 8 is also an isometric view showing a subsequent folding step.

FIG. 10 is a view similar to FIG. 4 showing the container in the erected state.

FIG. 11 is a section view taken along line X—X of FIG. 10 showing the multi-ply end panel construction.

DESCRIPTION OF THE PREFERRED EMBODIMENT

Figure 2:
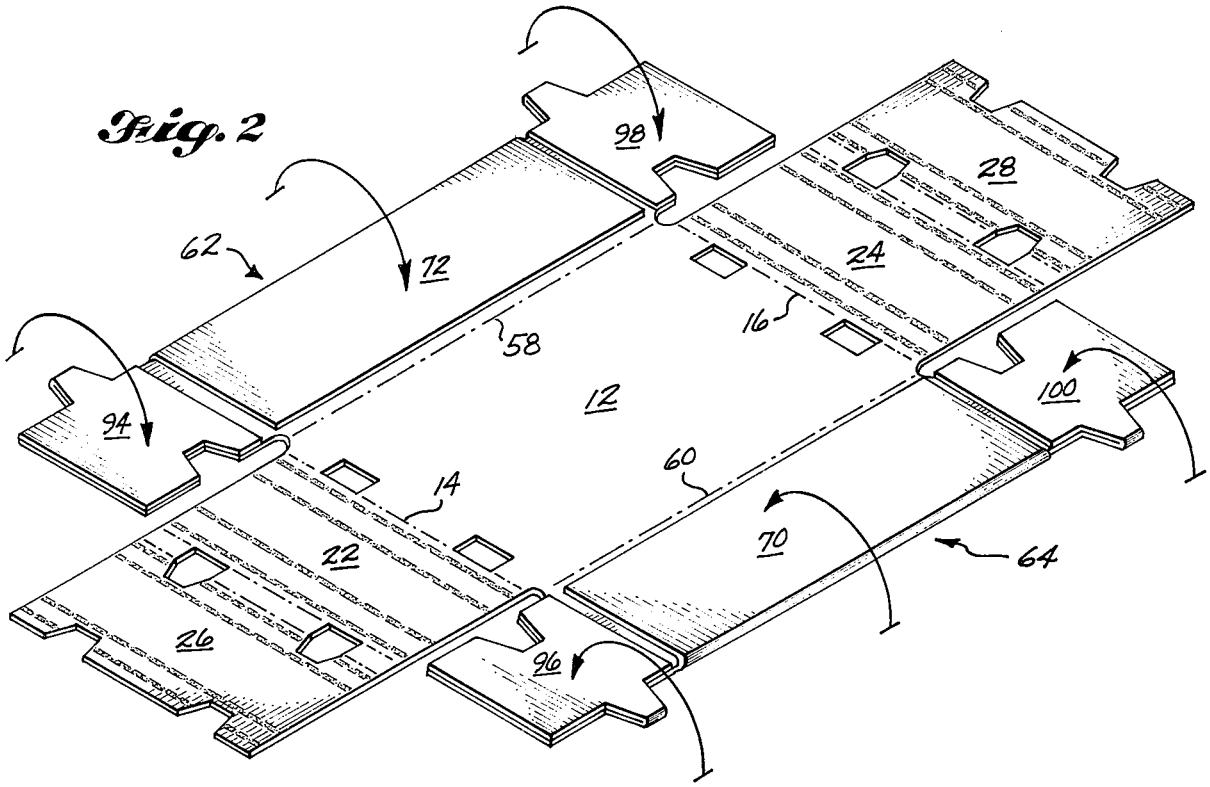
FIG. 2 is an isometric view of the container blank showing the sides being folded.

Referring now to the drawing, and in particular to FIG. 1, the several separate and distinct panels comprising the container blank, generally depicted at 10, will be described. It is to be noted that container blank 10 is comprised of a single piece of containerboard, which can be comprised, for example, of typical double-faced corrugated medium. Such containerboard material is,, of course, well known to those skilled in the art and comprises no part of the present invention.

The central portion of the container blank 10 is the bottom panel 12 which will form the bottom of the erected container. The bottom panel 12 will generally be in the shape of a rectangle as is customary in the art, although other planer configurations are within the scope of the present invention.

With respect to a directional convention, it will be taken for purposes of further description that the longitudinal direction will be that direction along the longer dimension of the bottom panel 12, while the transverse direction will be taken as being along the shorter dimension of bottom panel 12. Extending outwardly in the longitudinal direction from either transverse edge of bottom panel 12 along respective hinge lines 14, 16 are the end walls 18, 20 that, when in the erected state, form a portion of the overall end panel. The end walls 18, 20 are comprised of a first outer wall, 22 and 24 respectively, separated from second inner walls through a double hinge line or score line with the second inner end walls being designated as 26 and 28 respectively and the double hinge lines as 30 and 32 respectively. By a double hinge line or score line, it is meant that the fold can accept a double thickness of containerboard within the fold such that when the adjacent walls are folded 180°, they will remain in a vertical plane with two plies of containerboard between.

The first end walls 22, 24 will have a height (which extends in a longitudinal direction) that is equal to the depth of the erected container, since the first walls 22, 24 will form the outermost ply of the overall multi-ply end panel. The second end walls 26, 28 will be approximately equal in dimensions to the first walls, except that they will be slightly shorter in order to accommodate the thickness of bottom panel 12, as will become apparent later.

Since the present container blank 10 is designed for offering four upwardly extending stacking tabs from the end panels, a similar number of suitable cutouts must be provided to accommodate the tabs. In the bottom panel 12, four cutouts 34, 36, 38 and 40 are provided appropriately spaced along opposed transverse hingelines 14, 16. The cut-outs are generally rectangular and, as will be apparent to those skilled in the art, are sized in order to accommodate the upwardly extending and protruding stacking tabs from a container which is directly beneath the bottom panel 12. Of course, the cutouts 34, 36, 38 and 40 are spaced inwardly from the hingelines 14, 16 and directly within the bottom panel 12. Additional cutouts 42, 44, 46 and 48 are established along the double hingelines 30, 32 to be in registry with the cutouts 34, 36 38 and 40 such that when the container is erected, the stacking tabs will protrude upwardly through the double hingelines 30, 32. Along the outer transverse edges of second end walls 26, 28 are cutouts 50, 52 54 and 56 that will provide the relief space at the bottom of the erected container for the upwardly extending protruding stacking tabs.

Extending outwardly in the transverse direction from the longitudinal hingelines 58, 60 are the side panels generally indicated at 62 and 64. The side panels 62, 64 are also comprised of two walls, the first side walls being indicated as 66 and 68 respectively and which are separated from the second side walls 70, 72 respectively by longitudinally extending single hingelines 74, 76 respectively. The transverse dimension of the first walls 66, 68 is, of course, equal to the overall depth of the container in the erected state while the longitudinal dimension will be equal to the length of the erected container. The second walls 70, 72 will be slightly less in the transverse dimension and also slightly less in the longitudinal dimension in order to accommodate the overall end panels when the container is in the erected state. This will become more apparent later.

Extending outwardly from each transverse edge of the first walls 66, 68 along respective hingelines 78, 80, 82 and 84 are the first split interior end walls 86, 88, 90 and 92 respectively. By the modifier split it is meant that the interior end walls 86, 88, 90 and 92 extend only over a portion of the transverse dimension of the overall end panel. Thus, the longitudinal dimension of each interior end wall 86, 88, 90 and 92 will be equal to or slightly less than half of the transverse dimension of the end walls 18, 20. Of course, it will be recognized by those skilled in the art that when the container is erected, the end walls 86, 88, 90 and 92 will extend in the transverse direction with respect to the erected container. The transverse dimension of the split interior end walls is substantially equal to the transverse dimension of the side walls 66, 68.

Extending outwardly in the transverse direction from the outer longitudinal edge of each split interior end wall 86, 88, 90, 92 are the second split interior end walls designated respectively as 94, 96, 98 and 100. Connecting each respective first and second interior end walls are the stacking tab arrangements 102, 104, 106 and 108 respectively. Stacking tabs are, of course, well known in the container field, and the stacking tab arrangements 102, 104, 106 and 108 are of the known type where in cutting the container blank the actual tabs are comprised of two tab portions 110 and 112 respectively, joined together through a hingeline 114 such that when the tab is folded over 180° a double ply tab will be formed. It will thus be appreciated that when the opposed first and second split interior end walls are folded, one over the other, during container erection the stacking tab arrangements 102, 104, 106 and 108 will be formed. As seen from FIG. 1, the bases of the tab portions 110, 112 are positioned along opposing longitudinal edges of the respective first and second split end walls.

The second split interior end walls 94, 96, 98 and 100 are generally sized the same as the first interior end walls 86, 88, 90 and 92 with both walls having cutout portions designated respectively as 116 and 118 in order to accommodate the stacking tabs that will protrude through the bottom of the erected container through cutouts 34, 36, 38 and 40. Folded over corresponding first and second split end walls will be referred to as interior double-ply end panels.

Figure 3:
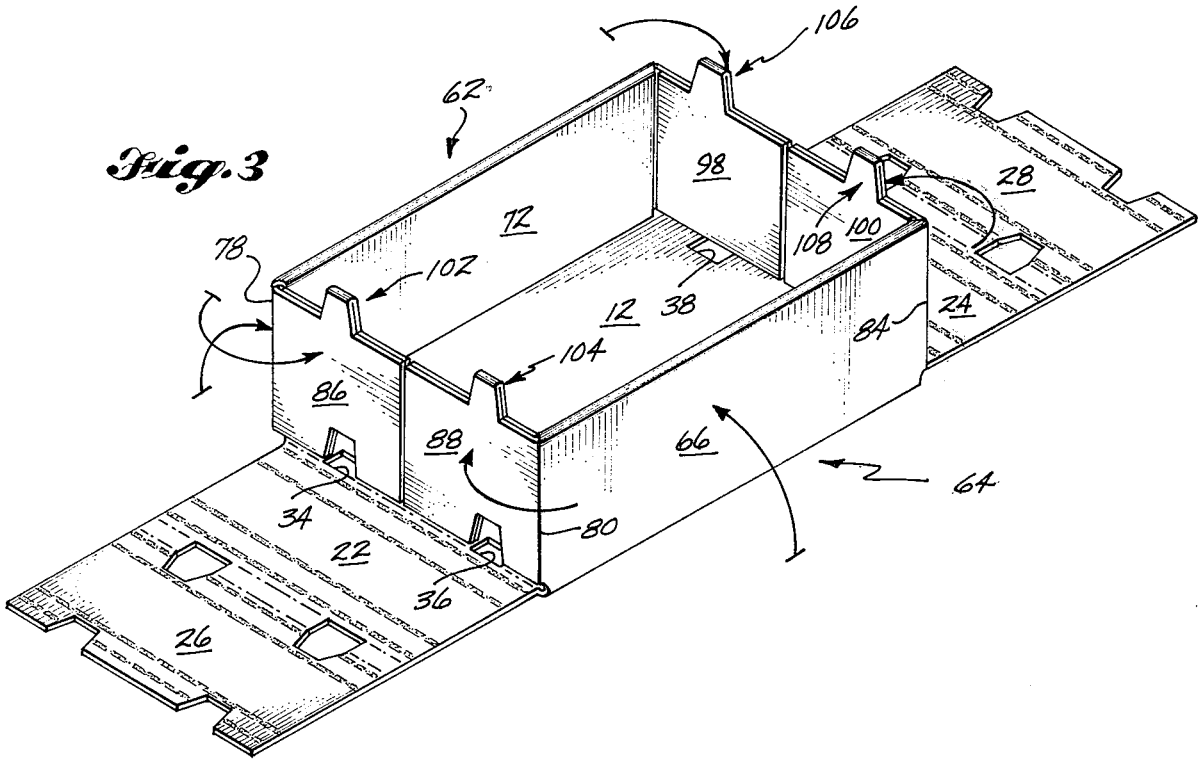
FIG. 3 is also an isometric view showing subsequent folding steps.
Figure 9:
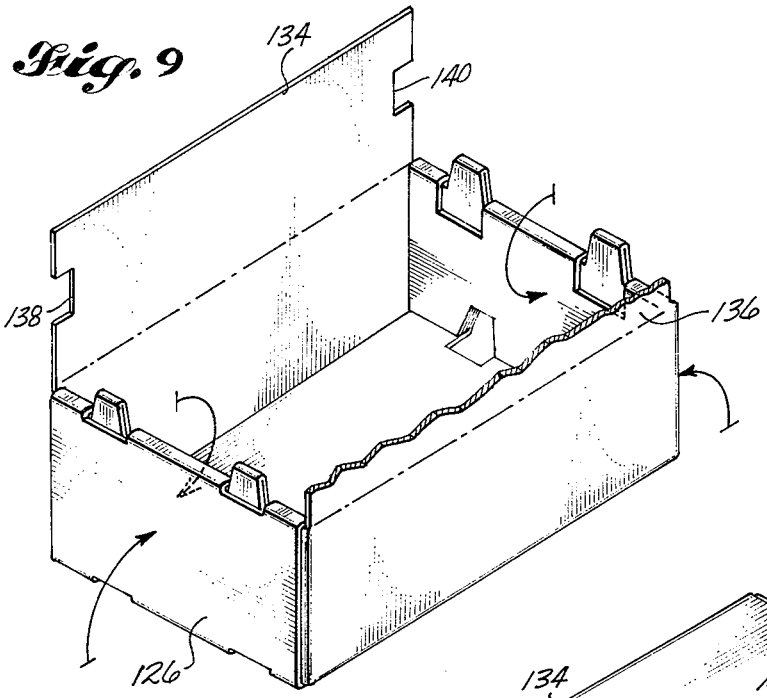
FIG. 9 is likewise an isometric view showing yet a further folding step.

Turning now to FIGS. 2 and 3 and referring back to FIG. 1 for a description of the adhesive pattern, the erection sequence will be described. It should be appreciated by those skilled in the art that the present container blank 10 can be erected on suitable automatic machinery such as a modified tray former. Likewise, the blank 10 can be erected manually through appropriate folding and adhesive application.

The first step in the erection process is to fold the second side walls 70, 72 and the second split interior end walls 94, 98 and 96, 100 over 180° such that they are juxtaposed against the respective first side walls 66, 68 and the first split interior ends walls 86, 90 and 88, 92. Prior to such folding, appropriate longitudinal adhesive lines designated collectively as 120 in FIG. 1 are applied to the container blank 10. Such an adhesive can be, for example, a suitable hot melt which could be applied through automatic applying means known to those skilled in the art.

As depicted in FIG. 3, the bonded side panels 62, 64 and the bonded first and second split interior end walls are then folded upwardly 90° while the split interior end walls are also folded 90° about hingelines 78, 80 and 82, 84 so as to form the partially erected container depicted in FIG. 3. At this point, the two-ply stacking tab arrangements 102, 104, 106 and 108 are readily apparent as are the cutout portions at the bottom of the container for accepting the protruding stacking tabs from a lower container.

The next step is the application of additional lines of suitable adhesive collectively designated as 122 in the transverse direction along second end walls 26 and 28. The first and second end walls 22, 24 and 26, 28 are then folded upwardly 90° and 180° respectively so as to overlay the surfaces of the interior double-ply end panels. The thusly formed container depicted as 124 in FIG. 4 will have two-ply side panels 62, 64 and four-ply end panels 126, 128 with the stacking tab arrangements 102, 104, 106 and 108 protruding upwardly from the tops of the end panels. In FIG. 5 a cross-sectional view is depicted through the formed end panel showing the four-ply construction and the upwardly extending stacking tab together with the overall cutout portion at the bottom of the container (arranged to accept the stacking tabs protruding upwardly from the bottom adjacent container).

The erected container 124 of FIG. 4 can then have applied to it a suitable top closure means (not shown) to cover the product. Any suitable top is within the purview of the present invention.

Turning now to FIG. 6 and one alternate embodiment of the present invention wherein like elements will be designated by like numbers as in the previously described embodiment, a container will be described that has, integral with a single-piece container blank 130, a suitable top closure means. The basic difference between the two embodiments is that the second walls 70, 72 of the side panels are left free in order to form the top closure means, which is designated generally as 132, instead of applying a continuous glueline and bonding the first and second side walls together. The longitudinal adhesive lines thus only extend over the first split interior end walls 86, 88, 90 and 92. The erecting sequence is essentially the same except that the second walls 70, 72 of the side panels 62, 64 are left free and in fact become the two top closure flaps 134 and 136 respectively, thereby forming the top closure means 132. Provided in the top closure flaps 134, 136 are cutout portions 138, 140, 142 and 144 respectively to accommodate the stacking tabs 102, 104 106 and 108 when the closure flaps 134, 136 are folded over after packing of the erected container, depicted as 146 in FIG. 10. With this configuration, the transverse edges of the closure flaps 134, 136 will overlay the tops of the end panels 126, 128, thereby forming a closed container. As depicted in FIG. 11, the cross-sectional view through the end panels 126, 128 are again comprised of four plies of containerboard, thereby offering a strong end panel construction. As a further alternative, the second end walls 26, 28 could be left free (not bonded to the interior double-ply end panels) to form part of the top closure 132 by overlaying or underlaying the top closure flaps 134, 136 and being bonded thereto. In this embodiment, the end panels 126, 128 would be comprised of three plies of containerboard.

Figure 12:
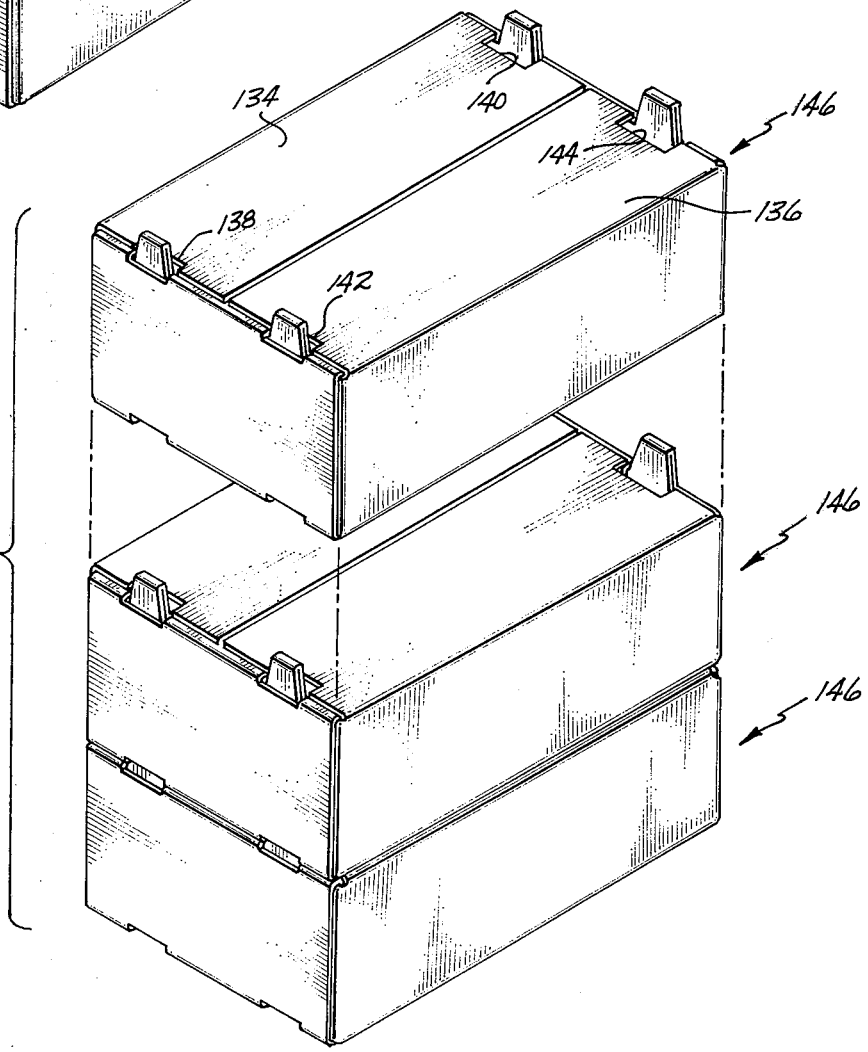
FIG. 12 is an isometric view showing a plurality of the containers of the present invention stacked vertically.

As depicted in FIG. 12, a plurality of vertically stacked erected containers 146 are relatively stable because the stacking tabs tend to stabilize and lock the stacked containers. Similarly, a plurality of containers are able to be stacked vertically because the multi-ply end panels provide suitable stacking strength for such an arrangement.

While detailed descriptions of several embodiments have been given, it is understood that many changes and modifications may be made in the above-described single-piece container blank without departing from the spirit of the invention. All such modifications are intended to be included within the scope of the appended claims.

What is claimed is:

1. A single-piece containerboard blank of the type that is erectable into a container having at least two side panels, two multi-ply end panels, and a bottom panel, comprising:

a generally rectangular bottom panel having longitudinal and transverse edges, and further having a pair of cutouts along each transverse edge, a first end wall extending outwardly from each transverse edge of said bottom panel connected to said bottom panel through a hinge line, and forming the outermost wall in each of said multi-ply end panels, a first side wall extending outwardly from each longitudinal edge of said bottom panel connected to said bottom panel through a hinge line and forming the outer wall in each of said side panels, first split interior end walls extending outwardly from each transverse edge of said first side walls having a longitudinal dimension that is equal to or less than one half of the transverse dimension of said first end walls and further having a cutout along the bottom longitudinal edge positioned so as to be in alignment with said plural cutouts in said bottom panel, second split interior end walls extending outwardly in the transverse direction from the outer longitudinal edge of each of said first split interior end walls with said corresponding first and second split interior end walls being connected together by stacking tab means and with said second split interior end walls having cutouts along the outer longitudinal edges positioned so as to be in alignment with said plural cutouts in said bottom panel and having approximately the same longitudinal dimension as said first split interior end walls, and said stacking tab means being comprised of two tab portions extending outwardly from opposing respective split interior end walls and hingedly connected together such that, when said container is erected, said stacking tabs will extend upwardly from the top edges of said multi-ply end panels.

2. The single piece blank as in claim 1 further including second side walls extending outwardly from said first side walls which will give additional strength to said side panels.

3. The single-piece blank as in claim 1 further including second end walls extending outwardly from said first end walls and connected together through a double hinge line with the double hinge line having cutouts therein in order to allow said stacking tabs to protrude therethrough.

* * * * *